US011173543B2

(12) United States Patent
Sasaki et al.

(10) Patent No.: US 11,173,543 B2
(45) Date of Patent: Nov. 16, 2021

(54) CASTING DEVICE FOR ENGINE CYLINDER BLOCK, CASTING MOLD FOR SAME, AND CASTING METHOD FOR SAME

(71) Applicant: Mazda Motor Corporation, Hiroshima (JP)

(72) Inventors: Daichi Sasaki, Aki-gun (JP); Kousuke Izumiuchi, Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 16/771,998

(22) PCT Filed: Nov. 28, 2018

(86) PCT No.: PCT/JP2018/043771

§ 371 (c)(1),
(2) Date: Jun. 11, 2020

(87) PCT Pub. No.: WO2019/116894

PCT Pub. Date: Jun. 20, 2019

(65) Prior Publication Data

US 2020/0398333 A1 Dec. 24, 2020

(30) Foreign Application Priority Data

Dec. 15, 2017 (JP) ..... JP2017-240294

(51) Int. Cl.
*B22C 9/24* (2006.01)
*B22C 9/10* (2006.01)
(Continued)

(52) U.S. Cl.
CPC ..... *B22C 9/24* (2013.01); *B22C 9/10* (2013.01); *B22D 19/08* (2013.01); *F02F 1/24* (2013.01);
(Continued)

(58) Field of Classification Search
CPC ... B22C 9/10; B22C 9/24; B22D 19/08; F02F 1/24; F02F 7/00; F02F 7/0021; F02F 7/0085; F02F 7/0095
(Continued)

(56) References Cited

U.S. PATENT DOCUMENTS 5,323,840 A * 6/1994 Usui et al. ..... B22D 17/24 164/312
6,250,368 B1 * 6/2001 Ushio et al. ..... B22D 19/0009 164/133

FOREIGN PATENT DOCUMENTS

CN 107457364 A 12/2017
JP 2009285658 A 12/2009
(Continued)

*Primary Examiner* — Kevin P Kerns
(74) *Attorney, Agent, or Firm* — Alleman Hall Creasman & Tuttle LLP

(57) ABSTRACT

Provided are a stationary mold configured to form a portion of a bearing portion of a crankshaft and a portion of a crankcase, and a movable mold including a plurality of bore pins respectively defining cylinder bores of cylinders. The bore pins are arranged to correspond to a cylinder bank including the plurality of cylinders. The movable mold is matched with the stationary mold such that portions of outermost ones of the plurality of bore pins in a series direction are each inclined away from another one of the plurality of bore pins adjacent to the outermost bore pin in the series direction toward a distal end of the outermost bore pin, where the series direction represents a direction in which the plurality of bore pins are arranged.

13 Claims, 10 Drawing Sheets

(51) Int. Cl.
*B22D 19/08* (2006.01)
*F02F 1/24* (2006.01)
*F02F 7/00* (2006.01)

(52) U.S. Cl.
CPC ..... *F02F 7/0095* (2013.01); *F02F 7/0021* (2013.01); *F02F 7/0085* (2013.01)

(58) Field of Classification Search
USPC ..... 164/112, 332, 137, 340, 342, 369, 113, 164/312
See application file for complete search history.

(56) References Cited

FOREIGN PATENT DOCUMENTS

| | | | |
|---|---|---|---|
| JP | 2010082679 | A | 4/2010 |
| JP | 2014176861 | A | 9/2014 |

* cited by examiner

CASTING DEVICE FOR ENGINE CYLINDER BLOCK, CASTING MOLD FOR SAME, AND CASTING METHOD FOR SAME

TECHNICAL FIELD

The present disclosure belongs to a technical field relating to a casting device for a cylinder block of an engine, a casting mold for the same, and a method for casting the same.

BACKGROUND ART

An open deck cylinder block including a portion of a bearing portion of a crankshaft and a portion of a crankcase has been known as a multi-cylinder engine cylinder block. In general, such cylinder blocks are produced by casting using a casting device.

For example, Patent Document 1 discloses a casting mold device (casting device) including a mold assembly that includes a stationary mold near a crank chamber and a movable mold near a cylinder head. The movable mold is provided with bore pins to hold respective cylinder liners.

In the casting mold device of Patent Document 1, a combination of the stationary and movable molds defines a cavity, with the cylinder liners respectively held by the bore pins. Molten metal is injected into the cavity, and is then solidified, thereby casting a cylinder block.

CITATION LIST

Patent Document

PATENT DOCUMENT 1: Japanese Unexamined Patent Publication No. 2014-176861

SUMMARY OF THE INVENTION

Technical Problem

However, the present inventors' studies showed that in a casting device similar to that of Patent Document 1, if a multi-cylinder engine cylinder block is produced by casting, outermost ones of cylinder bores in a longitudinal direction of a cylinder bank may tilt inwardly toward a crank chamber with respect to the longitudinal direction of the cylinder bank.

The present inventors' studies further showed that if molten metal is injected into the cavity so as to be solidified, and then a stationary mold is released, a portion of the cylinder block constituting a crankcase is shrunk or deformed. When a movable mold is released, the influence of residual stress arising from the shrinkage or deformation causes the outermost ones of the cylinder bores in the longitudinal direction of the cylinder bank to tilt inwardly toward the crankcase with respect to the longitudinal direction of the cylinder bank.

Tilting of the cylinder bores causes a relatively large gap to be formed between a piston inserted through each of the cylinder bores and the cylinder bore wall. This reduces the adhesion between the piston and the cylinder bore wall. As a result, gas escapes from a combustion chamber, and torque generated by combustion of fuel in the combustion chamber is reduced, resulting in poorer fuel economy. In addition, a large amount of oil is required to close the gap between the piston and the cylinder bore wall to enhance the adhesion between the piston and the cylinder bore wall. This increases the load under which an oil pump is driven, resulting in poorer fuel economy.

In view of the foregoing background, it is therefore an object of the present disclosure to, if a multi-cylinder engine cylinder block including a portion of a bearing portion of a crankshaft and a portion of a crankcase and having an open deck structure is produced by casting, reduce tilting of cylinder bores in a longitudinal direction of a cylinder bank and reduce the degree of reduction in fuel economy.

Solution to the Problem

In order to solve the problems, the present disclosure is directed to a casting device for a cylinder block of an engine. The casting device is configured to cast an open deck cylinder block including a portion of a bearing portion of a crankshaft and a portion of a crankcase. The engine is a multi-cylinder engine including a plurality of cylinders arranged in a line. The casting device includes: a first mold configured to form the portion of the bearing portion and the portion of the crankcase; a second mold including a plurality of bore pins respectively defining cylinder bores of the plurality of cylinders, the bore pins being arranged to correspond to a cylinder bank including the plurality of cylinders; and an injection device configured to inject molten metal into a cavity formed by the first and second molds matched. Outermost ones of the plurality of bore pins in a series direction each have an inclined portion that is inclined away from another one of the bore pins adjacent to the outermost bore pin in the series direction toward a distal end of the outermost bore pin, where the series direction represents a direction in which the plurality of bore pins are arranged and which corresponds to a longitudinal direction of the cylinder bank.

According to this configuration, while the first and second molds are matched to form the cavity, the inclined portions of the outermost ones of the bore pins in the series direction (hereinafter referred to as "outermost bore pins") are each inclined away from another one of the bore pins adjacent to the outermost bore pin in the serial direction toward the distal end of the outermost bore pin. Thus, the cylinder bores respectively defined by the outermost bore pins (hereinafter referred to as "outermost cylinder bores") are inclined outwardly in the longitudinal direction of the cylinder bank toward the crankcase before the second mold is released. Thereafter, when the second mold is released, residual stress arising from the shrinkage or deformation of the portions of the bearing portion of the crankshaft and crankcase is applied to the outermost cylinder bores. Each outermost cylinder bore rotates, and is displaced, inwardly in the longitudinal direction of the cylinder bank due to the residual stress. Thus, the outward inclinations of the outermost cylinder bores in the longitudinal direction of the cylinder bank before the release of the second mold are canceled, and the inclinations of the outermost cylinder bores in the longitudinal direction of the cylinder bank after the release of the second mold are reduced.

This can reduce the inclinations, in the series direction, of the cylinder bores, and can reduce the degree of reduction in fuel economy.

In one preferred embodiment of the casting device for the cylinder block of the engine, the cylinder bores of the cylinders are each defined by a cylinder liner that is cast in an alloy; the bore pins each have a liner holder configured to hold the cylinder liner; the inclined portions are configured as the liner holders; and while the cylinder liners are respectively held by the liner holders, and the first and second molds are matched, the injection device injects molten metal into the cavity.

According to this configuration, the cylinder bores are respectively defined by the cylinder liners. Thus, portions of the cylinder bores in each of which the cylinder liner is cast extend straight along the axis of the cylinder liner. When the outermost cylinder bores rotate, and are displaced, inwardly in the longitudinal direction of the cylinder bank due to the residual stress, the cylinder liners defining the outermost cylinder bores rotate, and are displaced. Thus, after the second mold is released, the following situation is less likely to occur in which only portions of the outermost cylinder bores in the axial direction are inclined in the longitudinal direction of the cylinder bank, thereby causing the outermost cylinder bores to be curved in the longitudinal direction of the cylinder bank. This can more effectively reduce the inclinations of the associated cylinder bores in the longitudinal direction of the cylinder bank.

Further, since the cylinder bores are respectively defined by the cylinder liners, the circularity of the cylinder bores can be also increased.

Another aspect of the present disclosure is directed to a casting mold for a cylinder block of an engine. Specifically, the aspect is directed to a casting mold for a cylinder block of an engine. The casting mold is configured to cast an open deck cylinder block including a portion of a bearing portion of a crankshaft and a portion of a crankcase. The engine is a multi-cylinder engine including a plurality of cylinders arranged in a line. The casting mold includes: a first mold configured to form the portion of the bearing portion and the portion of the crankcase; and a second mold including a plurality of bore pins respectively defining cylinder bores of the cylinders, the bore pins being arranged to correspond to a cylinder bank including the plurality of cylinders, the second mold being matched with the first mold to form a cavity to cast the cylinder block. Outermost ones of the plurality of bore pins in a series direction each have an inclined portion that is inclined away from another one of the bore pins adjacent to the outermost bore pin in the series direction toward a distal end of the outermost bore pin, where the series direction represents a direction in which the plurality of bore pins are arranged and which corresponds to a longitudinal direction of the cylinder bank.

According to this configuration, while the first and second molds are matched to form the cavity, the inclined portions of the outermost bore pins are each inclined away from another one of the bore pins adjacent to the outermost bore pin in the serial direction toward the distal end of the outermost bore pin. Thus, the outermost cylinder bores are inclined outwardly in the longitudinal direction of the cylinder bank toward the crankcase before the second mold is released. Thus, when the second mold is released, and thus, the outermost cylinder bores rotate, and are displaced, inwardly in the longitudinal direction of the cylinder bank due to the residual stress, the outward inclinations of the outermost cylinder bores in the longitudinal direction of the cylinder bank are canceled, and the inclinations of the outermost cylinder bores in the longitudinal direction of the cylinder bank are reduced.

This can reduce the inclinations, in the series direction, of the cylinder bores, and can reduce the degree of reduction in fuel economy.

In one preferred embodiment of the casting mold for the cylinder block of the engine, the cylinder bores of the cylinders are each defined by a cylinder liner that is cast in an alloy, the bore pins each have a liner holder configured to hold the cylinder liner, and each of the inclined portions is configured as the liner holder.

According to this configuration, the cylinder bores are respectively defined by the cylinder liners. Thus, portions of the cylinder bores in each of which the cylinder liner is cast extend straight along the axis of the cylinder liner. When the outermost cylinder bores rotate, and are displaced, inwardly in the longitudinal direction of the cylinder bank due to the residual stress, the cylinder liners defining the outermost cylinder bores rotate, and are displaced. Thus, after the second mold is released, the following situation is less likely to occur in which only portions of the outermost cylinder bores in the axial direction are inclined in the longitudinal direction of the cylinder bank, thereby causing the outermost cylinder bores to be curved in the longitudinal direction of the cylinder bank. This can more effectively reduce the inclinations of the associated cylinder bores in the longitudinal direction of the cylinder bank.

Still another aspect of the present disclosure is directed to a method for casting a cylinder block of an engine. Specifically, the aspect is directed to a method for casting a cylinder block of an engine, the method being used to cast an open deck cylinder block including a portion of a bearing portion of a crankshaft and a portion of a crankcase. The engine is a multi-cylinder engine including a plurality of cylinders arranged in a line. The method includes: matching a first mold and a second mold together to form a cavity to cast the cylinder block, the first mold being configured to form portions of the bearing portion and the crankcase, the second mold including a plurality of bore pins respectively defining cylinder bores of the cylinders, the bore pins being arranged to correspond to a cylinder bank including the plurality of cylinders; injecting molten metal into the cavity formed in the matching; and after the injecting of the molten metal, releasing the first mold and then releasing the second mold, and in the matching, the second mold is matched with the first mold such that portions of outermost ones of the plurality of bore pins in a series direction are inclined away from another one of the plurality of bore pins adjacent to the outermost bore pin in the series direction toward a distal end of the outermost bore pin, where the series direction represents a direction in which the plurality of bore pins are arranged and which corresponds to a longitudinal direction of the cylinder bank.

According to this configuration, while the first and second molds are matched to form the cavity, at least portions of the outermost bore pins are each inclined away from another one of the bore pins adjacent to the outermost bore pin in the serial direction toward the distal end of the outermost bore pin. Thus, the outermost cylinder bores are inclined outwardly in the longitudinal direction of the cylinder bank toward the crankcase before the second mold is released. When the second mold is released in the releasing, each outermost cylinder bore rotates, and is displaced, inwardly in the longitudinal direction of the cylinder bank due to the residual stress. Thus, the outward inclinations of the outermost cylinder bores in the longitudinal direction of the cylinder bank are canceled, and the inclinations of the outermost cylinder bores in the longitudinal direction of the cylinder bank are reduced.

This can reduce the inclinations, in the series direction, of the cylinder bores, and can reduce the degree of reduction in fuel economy.

In one preferred embodiment of the method for casting the cylinder block of the engine, the second mold is formed such that before the second mold is matched with the first mold in the matching, the portions of the outermost ones of the plurality of bore pins in the series direction are each inclined away from another one of the plurality of bore pins adjacent to the outermost bore pin in the series direction toward the distal end of the outermost bore pin, and in the matching, the second mold is matched with the first mold.

According to this configuration, before the second mold is matched with the first mold, the outermost bore pins are each inclined away from another one of the bore pins adjacent to the outermost bore pin in the serial direction toward the distal end of the outermost bore pin. Thus, in the matching, simply matching the first and second molds together allows the outermost bore pins to be each inclined away from the one of the bore pins adjacent to the outermost bore pin in the serial direction toward the distal end of the outermost bore pin. This can simplify the matching and can more effectively reduce the inclinations of the associated cylinder bores in the longitudinal direction of the cylinder bank.

In one preferred embodiment of the method for casting the cylinder block of the engine, the cylinder bores of the cylinders are each defined by a cylinder liner that is cast in an alloy; the bore pins of the second mold each have a liner holder configured to hold the cylinder liner; the method further includes, before the matching, holding the cylinder liners on the respective bore pins of the second mold, the cylinder liners respectively holding the cylinders, and in the matching, the second mold is matched with the first mold such that the liner holders of the outermost ones of the plurality of bore pins in the series direction are each inclined away from the another one of the bore pins adjacent to the outermost bore pin in the series direction toward the distal end of the outermost bore pin.

According to this configuration, the cylinder bores are respectively defined by the cylinder liners. Thus, portions of the cylinder bores in each of which the cylinder liner is cast extend straight along the axis of the cylinder liner. When the outermost cylinder bores rotate, and are displaced inwardly in the longitudinal direction of the cylinder bank due to the residual stress, the cylinder liners defining the outermost cylinder bores rotate, and are displaced. Thus, after the second mold is released in the releasing, the following situation is less likely to occur in which only portions of the outermost cylinder bores in the axial direction are inclined in the longitudinal direction of the cylinder bank, thereby causing the outermost cylinder bores to be curved in the longitudinal direction of the cylinder bank. This can more effectively reduce the inclinations of the associated cylinder bores in the longitudinal direction of the cylinder bank.

In one embodiment of the method for casting the cylinder block of the engine, the cylinder block is an upper block to be fastened to a lower block including remaining portions of the bearing portion and the crankcase.

According to this configuration, residual stress tends to be applied from a portion of the cylinder block constituting the crankcase to the cylinder bores. This can reduce the inclinations, in the series direction, of the cylinder bores and can more properly reduce the degree of reduction in fuel economy.

Advantages of the Invention

As described above, according to a casting device for a cylinder block of an engine, a casting mold for the same, and a method for casting the same, while first and second molds are matched to form a cavity, inclined portions of outermost ones of a plurality of bore pins of the second mold in the series direction are each inclined away from another one of the bore pins adjacent to the outermost bore pin in the serial direction toward a distal end of the outermost bore pin. Thus, the outermost cylinder bores respectively defined by the outermost bore pins in the series direction are inclined outwardly in the longitudinal direction of the cylinder bank toward the crankcase before the second mold is released. Thereafter, when the second mold is released, the outermost cylinder bores rotate, and are displaced, inwardly in the longitudinal direction of the cylinder bank due to residual stress arising from the shrinkage or deformation of portions of the bearing portion of the crankshaft and the crankcase. Thus, the inclinations of the outermost cylinder bores in the longitudinal direction of the cylinder bank after the release of the second mold are reduced. This can reduce the inclinations, in the series direction, of the cylinder bores, and can reduce the degree of reduction in fuel economy caused by the inclinations of the cylinder bores in the longitudinal direction of the cylinder bank.

DESCRIPTION OF EMBODIMENTS

First Embodiment

A first exemplary embodiment will now be described in detail with reference to the drawings. The vertical and horizontal directions of a cylinder block 100 are recognized as indicated by the arrows shown in FIG. 1.

Figure 1:
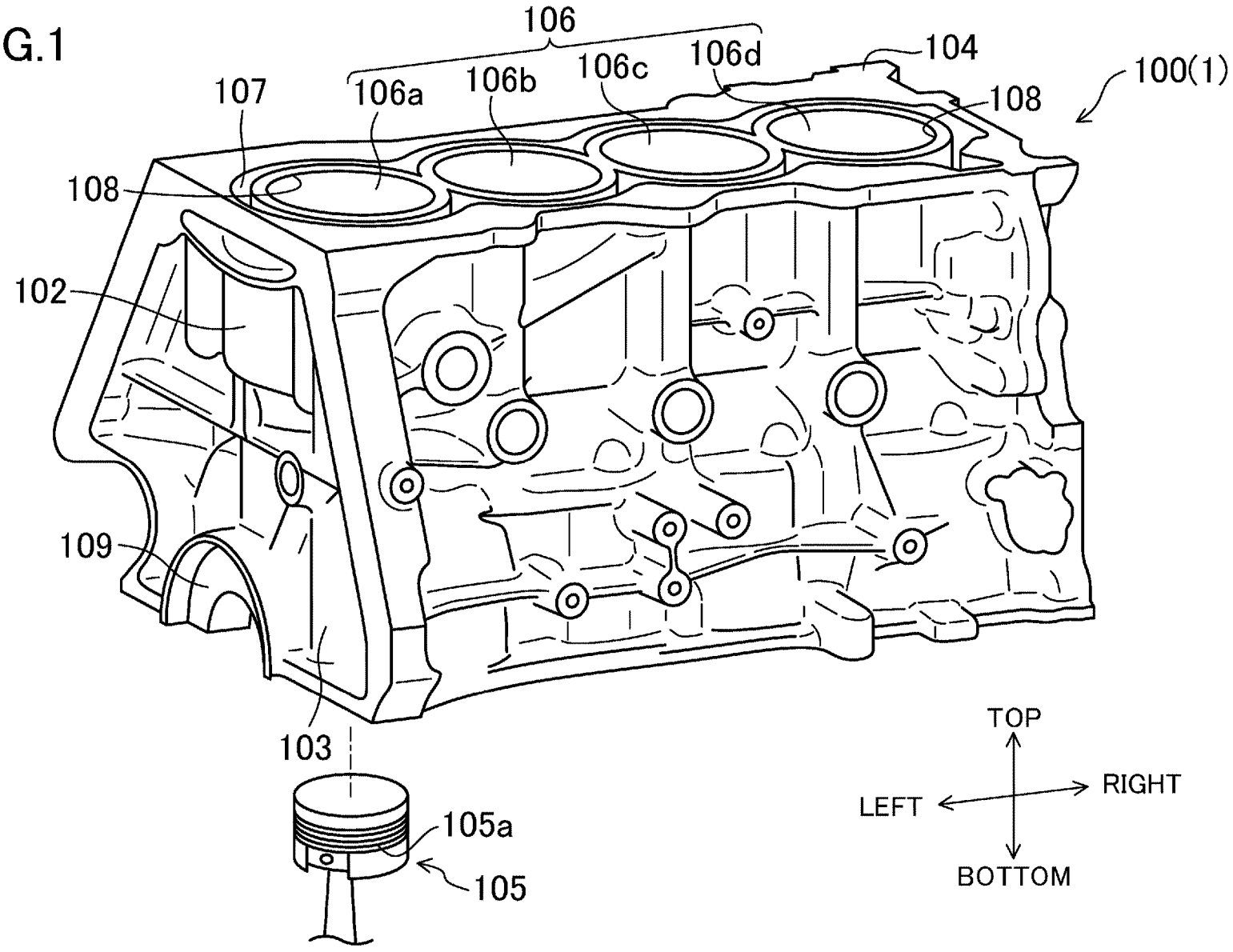
FIG. 1 is a perspective view of a cylinder block cast by a casting device according to a first embodiment.

FIG. 1 shows the cylinder block 100 cast by a casting device 10 (see FIG. 2) according to the first embodiment. The cylinder block 100 is a cylinder block for use in a multi-cylinder engine 1 including four in-line cylinders, which are arranged in a line. The cylinder block 100 is made of an aluminum alloy, and includes a cylinder portion 102 including the cylinders, and a crankcase portion 103 provided under the cylinder portion 102 and forming a portion of a crankcase. The cylinder block 100 according to the first embodiment is an upper block including the cylinder portion 102 and the crankcase portion 103. A lower block (not shown) including the remaining portion of the crankcase is fastened to the cylinder block 100. The crankcase includes the crankcase portion 103, and the lower block coupled to the crankcase portion 103 from below.

The cylinder portion 102 has a gasket surface 104 which is adjoined to a cylinder head (not shown), cylinder bores 106 which each have an end opening through the gasket surface 104 and through each of which a piston 105 is inserted, and a water jacket 107 surrounding the outer walls of the cylinder bores 106. In the first embodiment, the cylinder bores 106 for the respective cylinders are respectively defined by cylinder liners 108 made of a metal different from an aluminum alloy and cast in the aluminum alloy. As shown in FIG. 1, in the first embodiment, the water jacket 107 has an open upper end. In other words, the cylinder block 100 is an open deck cylinder block.

The crankcase portion 103 has a plurality of bearing portions 109 for a crankshaft disposed in the crankcase. The bearing portions 109 are respectively formed at lower ends of two walls outside first and fourth outermost cylinder bores 106*a* and 106*d* in the longitudinal direction of the cylinder bank and lower ends of walls between two adjacent ones of the cylinder bores 106 in the longitudinal direction of the cylinder bank (e.g., a wall between the first cylinder bore 106*a* and a second cylinder bore 106*b*), where the four cylinder bores 106 are respectively referred to as "first, second, third, and fourth cylinder bores 106*a*, 106*b*, 106*c*, and 106*d*" in this order from left to right in the longitudinal direction of the cylinder bank (corresponding to the horizontal direction shown in FIG. 1). If there is no need to distinguish these cylinder bores 106, they may be simply referred to as a "cylinder bore(s) 106." FIG. 1 shows only one of the bearing portions 109 provided at the lower end of the wall located outside the first cylinder bore 106*a* in the longitudinal direction of the cylinder bank. The other bearing portions 109 overlap with the other walls of the cylinder block 100, and are thus invisible.

The piston 105 is provided with a plurality of piston rings 105*a* to maintain the adhesion between the piston 105 and the cylinder bore wall of the associated cylinder bore 106.

Next, the configuration of the casting device 10 will be described.

Figure 2:
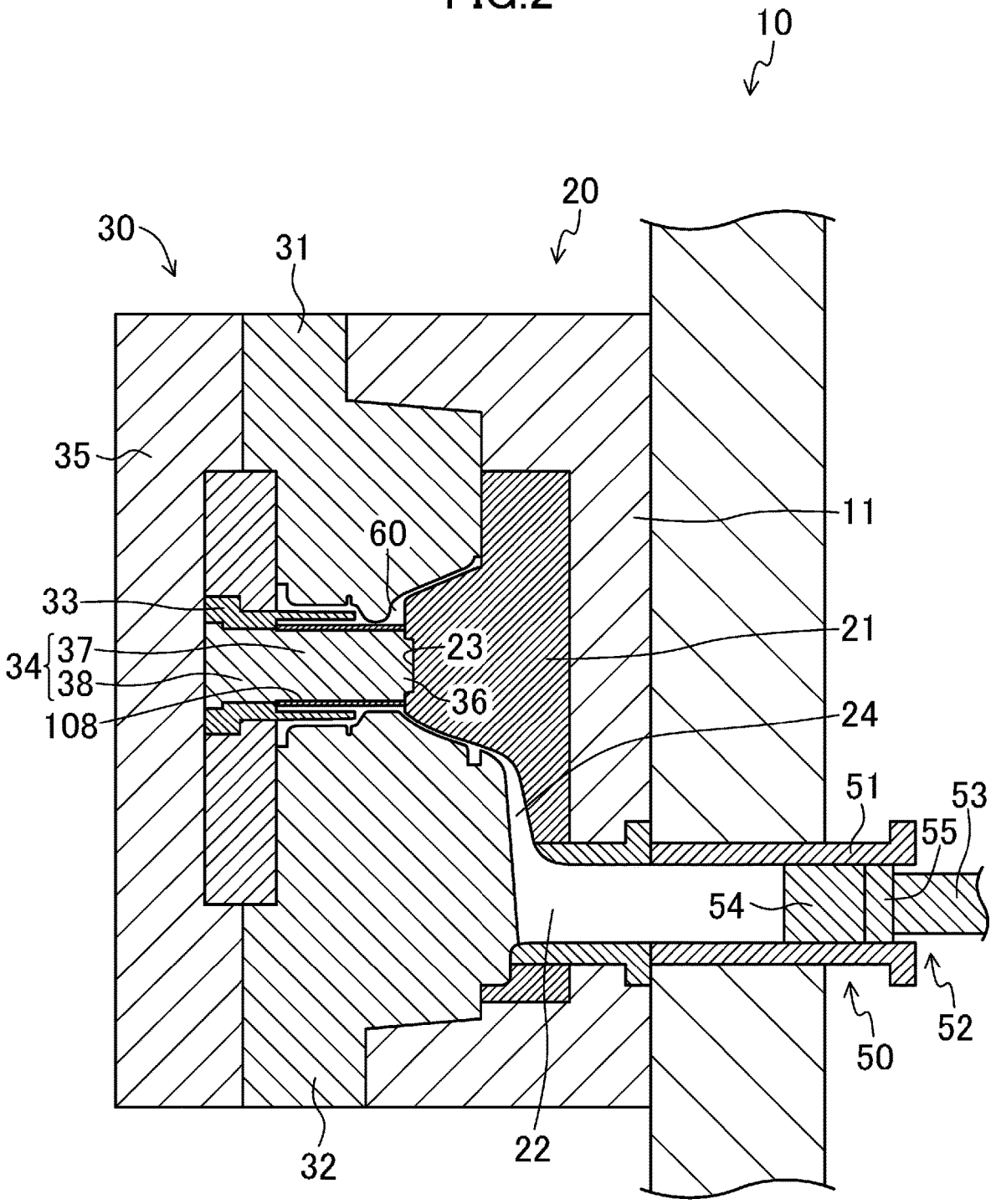
FIG. 2 is a cross-sectional view showing how movable and stationary molds are matched to form a cavity.

As shown in FIG. 2, the casting device 10 includes a stationary mold 20 (a first mold) for forming the bearing portions 109 and the crankcase portion 103 of the cylinder block 100, and a movable mold 30 (a second mold) for forming the cylinder portion 102. The stationary and movable molds 20 and 30 form a casting mold assembly. The casting device 10 includes an injection device 50 configured to inject molten metal. The injection device 50 injects molten metal into a cavity 60 defined by the stationary and movable molds 20 and 30 matched.

The stationary mold 20 is fixed to a stationary mold base 11 of the casting device 10. The stationary mold 20 has a stationary mold core 21 for forming a crank chamber of the crankcase. The stationary mold 20 has a sprue 22 through which the molten metal is supplied from the injection device 50 to the cavity 60.

As shown in FIG. 2, a portion of the stationary mold core 21 of the stationary mold 20 near the movable mold 30 has an engagement recess 23 recessed in a direction remote from the movable mold 30. The engagement recess 23 engages with an engaging portion 36 of an associated one of bore pins 34 of the movable mold 30 to be described below. The engagement recess 23 serves as a positioning portion configured to position the associated bore pin 34 when the stationary and movable molds 20 and 30 are matched. As will be described in detail below, each engagement recess 23 is formed at a position corresponding to associated one of the engagement protruding portions 36 of the bore pins 34.

The movable mold 30 includes first and second sliding molds 31 and 32, a jacket core 33, a plurality of (in this embodiment, four equal to the number of cylinders) bore pins 34, and a movable mold base plate 35. The first and second sliding molds 31 and 32 are slidable in a direction orthogonal to the direction in which the movable mold 30 moves. The jacket core 33 is used to form the water jacket 107 of the cylinder block 100. The bore pins 34 form the cylinder bores 106 of the cylinders, respectively. The jacket core 33 and the bore pins 34 are fixed to the movable mold base plate 35. The movable mold 30 further includes a shifter (not shown) configured to move the movable mold 30 to and away from the stationary mold 20, and an ejector (not shown) configured to release the movable mold 30 from a casting (in this embodiment, a cylinder block that has been cast).

As shown in FIG. 2, the first and second sliding molds 31 and 32 serve to form side wall portions of the cylinder block 100 in the direction orthogonal to both the longitudinal direction of the cylinder bank and the axial direction of the cylinder bores 106. A portion of the second sliding mold 32 near the stationary mold 20 works together with the stationary mold 20 to form a sprue runner 24 through which the molten metal supplied from the injection device 50 through the sprue 22 is guided to the cavity 60.

The jacket core 33 is a core for forming the water jacket 107 that integrally covers the peripheries of the outer walls of the four cylinder bores 106 as shown in FIG. 1. The jacket core 33 is continuously formed to cover all of the four bore pins 34 from the peripheries of the four bore pins 34.

The four bore pins 34 are arranged side by side so as to correspond to the longitudinal direction of the cylinder bank of the cylinder block 100. In the following description, a direction in which the four bore pins 34 are arranged, i.e., the direction corresponding to the longitudinal direction of the cylinder bank, is referred to as a "series direction."

Figure 3:
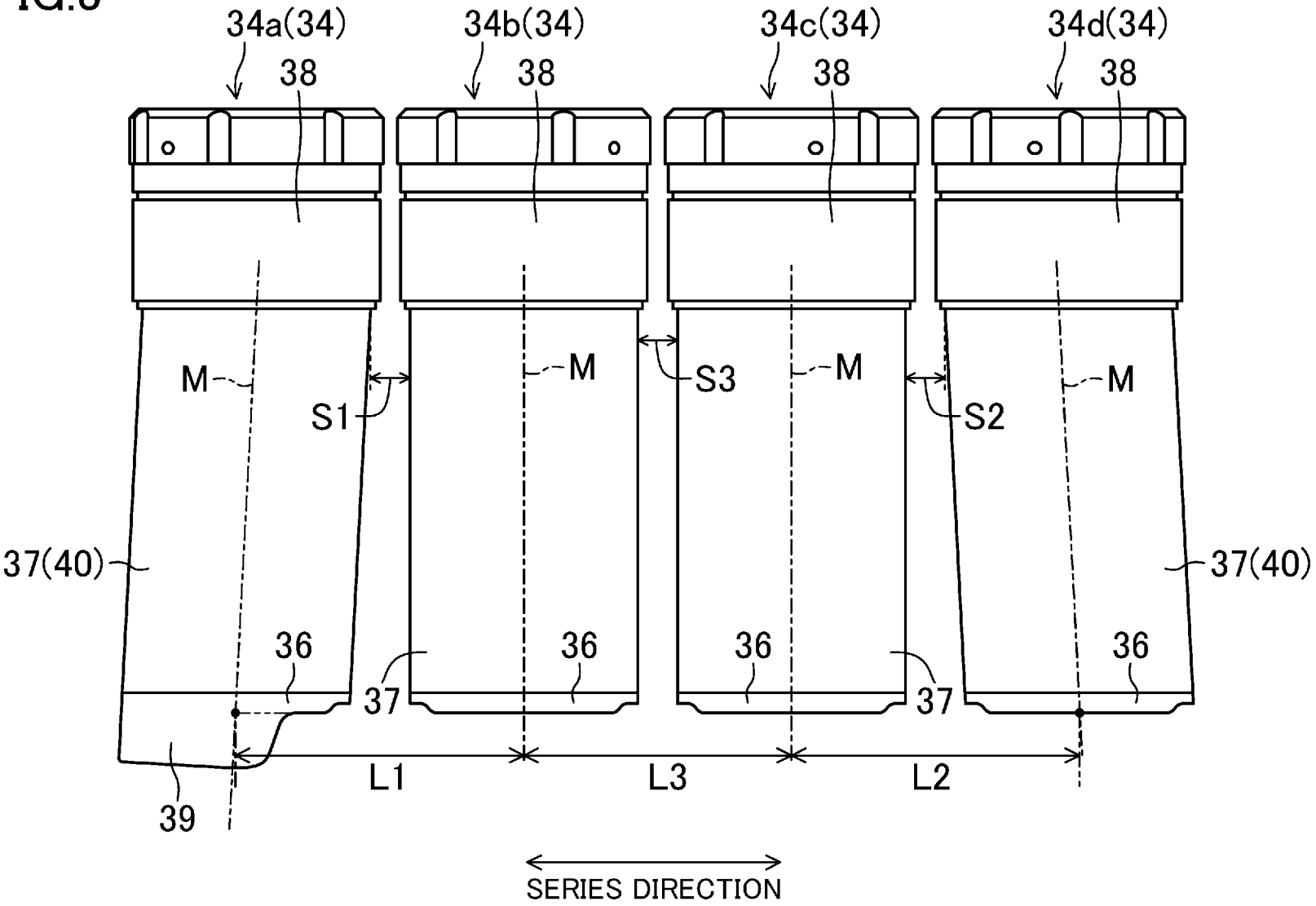
FIG. 3 is an enlarged view of portions of the movable mold corresponding to bore pins.

FIG. 3 shows, in an enlarged manner, the four bore pins 34 from the direction orthogonal to both the series direction and the axial direction of the bore pins 34. The four bore pins 34 are hereinafter referred to as "first, second, third, and fourth bore pins 34*a*, 34*b*, 34*c*, and 34*d*" in this order from left to right of FIG. 3. If there is no need to distinguish them, they may be simply referred to as a "bore pin(s) 34."

As shown in FIGS. 2 and 3, the four bore pins 34 each have a liner holder 37 and a stepped portion 38. The liner holder 37 is configured to hold the associated cylinder liner 108. The stepped portion 38 has a larger diameter than the liner holder 37, and is fixed to the movable mold base plate 35.

The diameter of the liner holder 37 of each of the bore pins 34 is set to be slightly smaller than the inside diameter of the associated cylinder liner 108 so that the liner holder 37 can hold the associated cylinder liner 108. On the other hand, the diameter of the stepped portion 38 of each of the bore pins 34 is set to be larger than the inside diameter of the associated cylinder liner 108. Thus, when the cylinder liners 108 are to be respectively held by the liner holders 37, the cylinder liners 108 each come into contact with the associated stepped portion 38 to prevent the cylinder liner 108 from moving further toward the movable mold base plate 35. This enables appropriate positioning of the cylinder liners 108.

A distal end portion of the liner holder 37 of each bore pin 34 is configured as the engagement protruding portion 36, which engages with the associated engagement recess 23 formed in the stationary mold core 21 of the stationary mold 20. Each engagement protruding portion 36 engages with the associated engagement recess 23 of the stationary mold core 21 when the stationary and movable molds 20 and 30 are matched. Thus, the bore pins 34 are positioned.

The first bore pin 34*a* further has a protruding portion 39 different from the engagement protruding portion 36 (see FIG. 3). The protruding portion 39 engages with a recess (not shown) formed on the stationary mold 20. When the stationary and movable molds 20 and 30 are matched, the protruding portion 39 is first engaged with the recess of the stationary mold 20, thereby roughly aligning these molds together. Then, the engagement protruding portions 36 are respectively engaged with the engagement recesses 23 to specifically position the bore pins 34.

The liner holders 37 of inner ones of the four bore pins 34 in the series direction, i.e., the second and third bore pins 34*b* and 34*c*, extend straight in the direction orthogonal to the series direction. On the other hand, the liner holders 37 of the outermost bore pins in the series direction, i.e., the first and fourth bore pins 34*a* and 34*d*, each form an inclined portion 40 that is inclined away from the bore pin 34 adjacent in the series direction, toward the distal ends of the first and fourth bore pins. Specifically, as shown in FIG. 3, the liner holder 37 of the first bore pin 34*a* extends from its base end (the boundary between the liner holder 37 and the stepped portion 38) toward its distal end so as to be inclined away from the second bore pin 34*b* in the series direction. Meanwhile, the liner holder 37 of the fourth bore pin 34*d* extends from its base end toward its distal end so as to be inclined away from the third bore pin 34*c* in the series direction. The first and fourth bore pins 34*a* and 34*d* are configured such that a gap S1 between the base end of the liner holder 37 of the first bore pin 34*a* and the base end of the liner holder 37 of the second bore pin 34*b* and a gap S2 between the base end of the liner holder 37 of the fourth bore pin 34*d* and the base end of the liner holder 37 of the third bore pin 34*c* are each smaller than a gap S3 between the base end of the liner holder 37 of the second bore pin 34*b* and the base end of the liner holder 37 of the third bore pin 34*c*. FIG. 3 shows, in an exaggerated manner, the inclinations of the inclined portions 40 for ease of viewing. Although will be described later in detail, the inclination angle of each of the actual inclined portions 40 is about 0.1° to 0.3°.

The liner holders 37 inclined in the series direction, such as those of the first and fourth bore pins 34*a* and 34*d*, can each have its portion cut away and have its portion increased in thickness.

Figure 5:
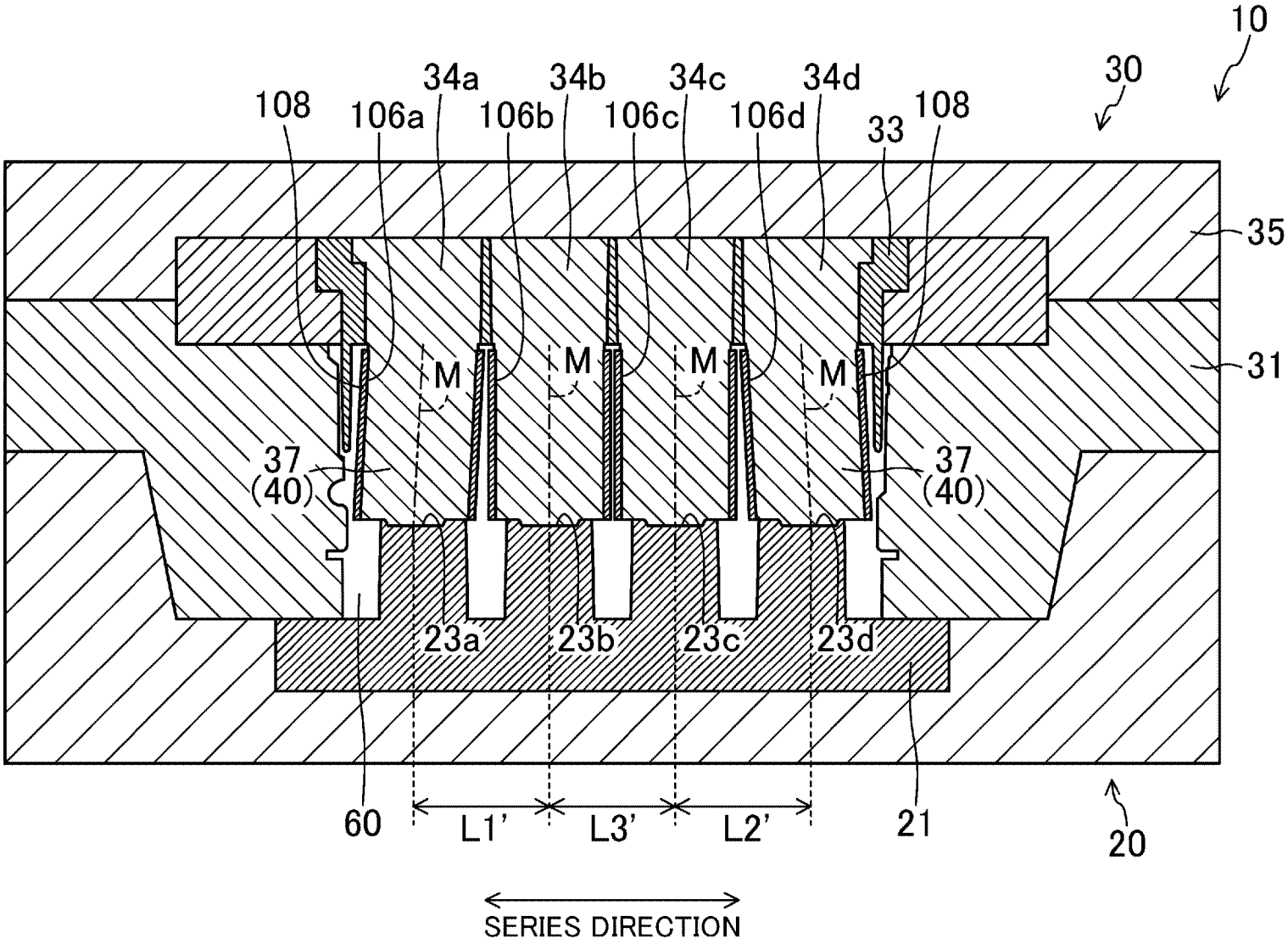
FIG. 5 is a cross-sectional view showing how molten metal has been injected into the cavity defined by the matched movable and stationary molds, and taken along the direction in which the bore pins are arranged in a line.

Since the liner holders 37 of the first and fourth bore pins 34*a* and 34*d* out of the four bore pins 34 are inclined in the series direction, the engagement protruding portions 36 of the bore pins 34 are not arranged at equal intervals in the series direction. Specifically, the engagement protruding portions 36 of the bore pins 34 are arranged such that the distance L1 between the midpoint of the engagement protruding portion 36 of the first bore pin 34*a* in the series direction and that of the engagement protruding portion 36 of the second bore pin 34*b* in the series direction (the distance between intersections of the center axes M with the engagement protruding portions 36) and the distance L2 between the midpoint of the engagement protruding portion 36 of the fourth bore pin 34*d* in the series direction and that of the engagement protruding portion 36 of the third bore pin 34*c* in the series direction are each longer than the distance L3 between the midpoint of the engagement protruding portion 36 of the second bore pin 34*b* in the series direction and that of the engagement protruding portion 36 of the third bore pin 34*c* in the series direction. Each of the engagement recesses 23 of the stationary mold core 21 of the stationary mold 20 is formed at the position corresponding to the associated engagement protruding portion 36 of the bore pin 34 such that when the stationary and movable molds 20 and 30 are matched, the liner holders 37 of the first and fourth bore pins 34*a* and 34*d* remain inclined. More specifically, as shown in FIG. 5, the engagement recesses 23 of the stationary mold core 21 are formed such that the distance L1' between the midpoints of the first and second engagement recesses 23*a* and 23*b* in the series direction and the distance L2' between the midpoints of the fourth and third engagement recesses 23*d* and 23*c* in the series direction are each longer than the distance L3' between the midpoints of the second and third engagement recesses 23*b* and 23*c* in the series direction, where the engagement recesses 23 respectively engaging with the engagement protruding portions 36 of the first, second, third, and fourth bore pins 34*a*, 34*b*, 34*c*, and 34*d* are respectively referred to as the "first, second, third, and fourth engagement recesses 23*a*, 23*b*, 23*c*, and 23*d*."

At least one of the stationary and movable molds 20 and 30 is provided with a gas vent (not shown) for discharging gas (air) in the cavity 60 when the molten metal is injected into the cavity 60.

As shown in FIG. 2, the injection device 50 includes a tubular injection sleeve 51, and an injection plunger 52 inserted through the injection sleeve 51 and capable of moving forward and backward in the axial direction of the cylindrical injection sleeve 51.

The injection sleeve 51 has a portion embedded in the stationary mold base 11, and the remaining portion protruding from the stationary mold base 11 in a direction remote from the stationary mold 20.

The injection plunger 52 includes a circular cylindrical rod 53, a circular cylindrical injection tip 54 for pressing the molten metal, and a joint 55 connecting the injection tip 54 to one end of the rod 53. The outer diameter of the injection tip 54 is set such that the outer peripheral surface thereof is slidable on the inner peripheral surface of the injection sleeve 51. Although not shown, the other end of the rod 53 is connected to a hydraulic cylinder as a plunger driving mechanism. The hydraulic cylinder is configured to be capable of changing the injection speed of the injection plunger 52. Operation of the hydraulic cylinder allows the injection speed of the injection plunger 52 to be appropriately adjusted so that the molten metal is appropriately injected into the cavity 60, which is thus filled with the molten metal.

Next, a method for casting the cylinder block 100 using the casting device 10 will be described with reference to FIGS. 4 to 7.

Figure 4:
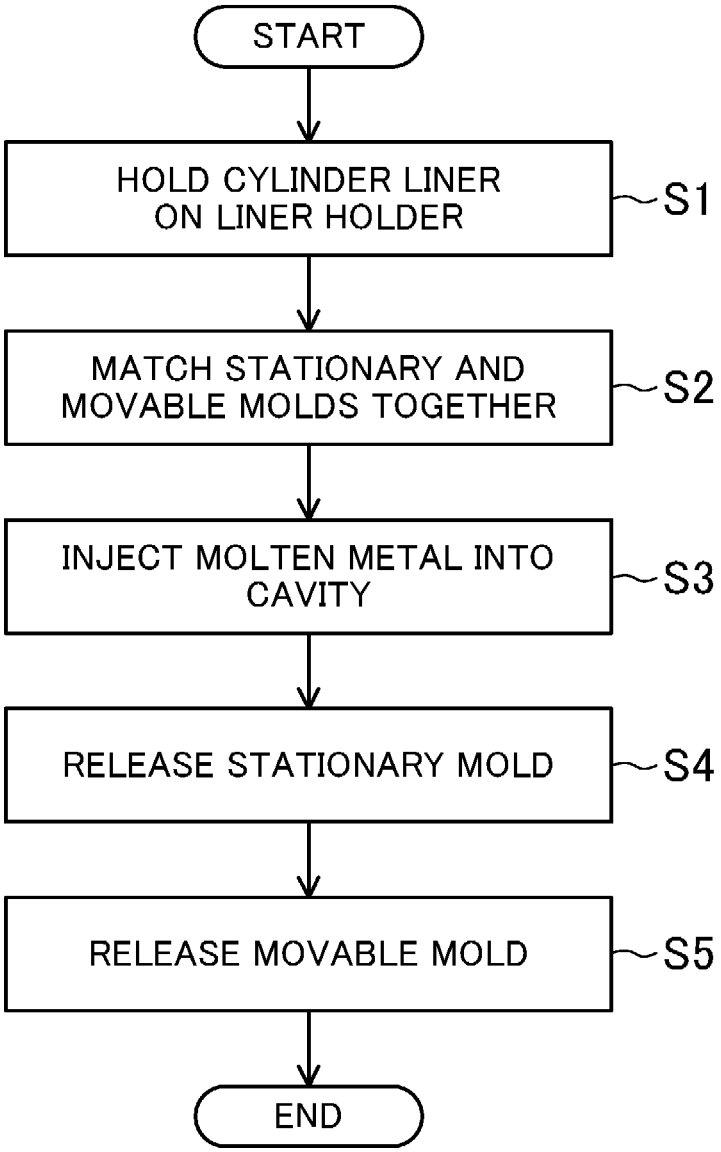
FIG. 4 is a flowchart showing a process for casting a cylinder block using the casting device.

FIG. 4 is a flowchart showing a process for casting the cylinder block 100 using the casting device 10.

To cast the cylinder block 100 using the casting device 10, the cylinder liners 108 are first each held by the liner holder 37 of the associated bore pin 34 of the movable mold 30 in step S1. At this moment, each cylinder liner 108 is fitted to the associated liner holder 37 until it comes into contact with the stepped portion 38 of the associated bore pin 34.

Next, in step S2, the stationary and movable molds 20 and 30 are matched. In step S2, to align the bore pins 34 with one another, the protruding portion 39 of the first bore pin 34*a* is first engaged with the recess of the stationary mold 20 as described above, thereby roughly aligning these bore pins together. Then, the engagement protruding portions 36 are respectively engaged with the engagement recesses 23 to specifically position the bore pins 34. In step S2, as shown in FIG. 5, the movable mold 30 is matched with the stationary mold 20 such that the liner holders 37 of the first and fourth bore pins 34*a* and 34*d* are inclined away from the second and third bore pins 34*b* and 34*c* toward the distal ends of the first and fourth bore pins 34*a* and 34*d*, respectively.

Next, in step S3, molten metal is injected into the cavity 60 defined by the stationary and movable molds 20 and 30 matched. In this injection of the molten metal, the molten metal is supplied into the injection sleeve 51, and then the molten metal supplied through driving of the injection plunger 52 is pushed toward the sprue 22 and sprue runner 24 of the stationary mold 20. Thus, the molten metal is injected into the cavity 60 through the sprue 22 and the sprue runner 24. FIG. 5 shows a state where the molten metal is yet to be injected into the cavity 60.

Subsequently, after a predetermined period has elapsed (after the molten metal has been solidified), the stationary mold 20 is released in step S4. This process is performed by the shifter moving a combination of the movable mold 30 and the movable mold base plate 35 away from the stationary mold 20.

Thereafter, in step S5, the movable mold 30 is released. This process is performed by an ejector pin (not shown) of the ejector pushing out the cast cylinder block 100.

In the foregoing manner, the cylinder block 100 is cast using the casting device 10.

Here, when the stationary mold 20 is released, the binding force exerted by the stationary mold 20 is lost. As a result, the crankcase portion 103 of the cylinder block 100 is shrunk or deformed. The residual stress arising from the shrinkage or deformation is applied to the cylinder portion 102 of the cylinder block 100. Thus, in releasing of the movable mold 30, outermost ones of the cylinder bores 106 in the longitudinal direction of the cylinder bank, i.e., the first and fourth cylinder bores 106*a* and 106*d*, rotate, and are displaced, inwardly toward the crankcase portion 103 in the longitudinal direction of the cylinder bank.

Liner holders of bore pins of a known movable mold extend straight in the direction orthogonal to the series direction. Thus, when the first and fourth cylinder bores 106*a* and 106*d* rotate, and are displaced, inwardly toward the crankcase portion 103 in the longitudinal direction of the cylinder bank, they are inclined inwardly toward the crankcase portion 103 in the longitudinal direction of the cylinder bank. In other words, the first and fourth bore pins 34*a* and 34*d* are respectively inclined to approach the second and third bore pins 34*b* and 34*c* toward the distal ends of the first and fourth bore pins 34*a* and 34*d*.

Tilting of a cylinder bore 106 causes a relatively large gap to be formed between the piston 105 inserted through the cylinder bore 106 and the cylinder bore wall. This reduces the adhesion between the piston 105 and the cylinder bore wall. As a result, gas escapes from a combustion chamber, and torque generated by combustion of fuel in the combustion chamber is reduced, resulting in poorer fuel economy. In addition, a large amount of oil is required to close the gap between the piston 105 and the cylinder bore wall to enhance the adhesion between the piston 105 and the cylinder bore wall. This increases the load under which an oil pump is driven, resulting in poorer fuel economy.

In contrast, in the first embodiment, the outermost ones of the bore pins 34 of the movable mold 30 in the series direction (the first and fourth bore pins 34*a* and 34*d*) each have an inclined portion 40 (the liner holder 37) that is inclined away from the bore pin 34 adjacent in the series direction (the second bore pin 34*b* for the first bore pin 34*a*, the third bore pin 34*c* for the fourth bore pin 34*d*) toward the distal end of the outermost bore pin 34. The movable mold 30 is matched with the stationary mold 20 such that the inclined portion 40 of each of the outermost bore pins 34 is inclined away from the bore pin 34 adjacent in the series direction toward the distal end of the bore pin 34. This can reduce the inward inclinations of the first and fourth cylinder bores 106*a* and 106*d* in the series direction.

Figure 6:
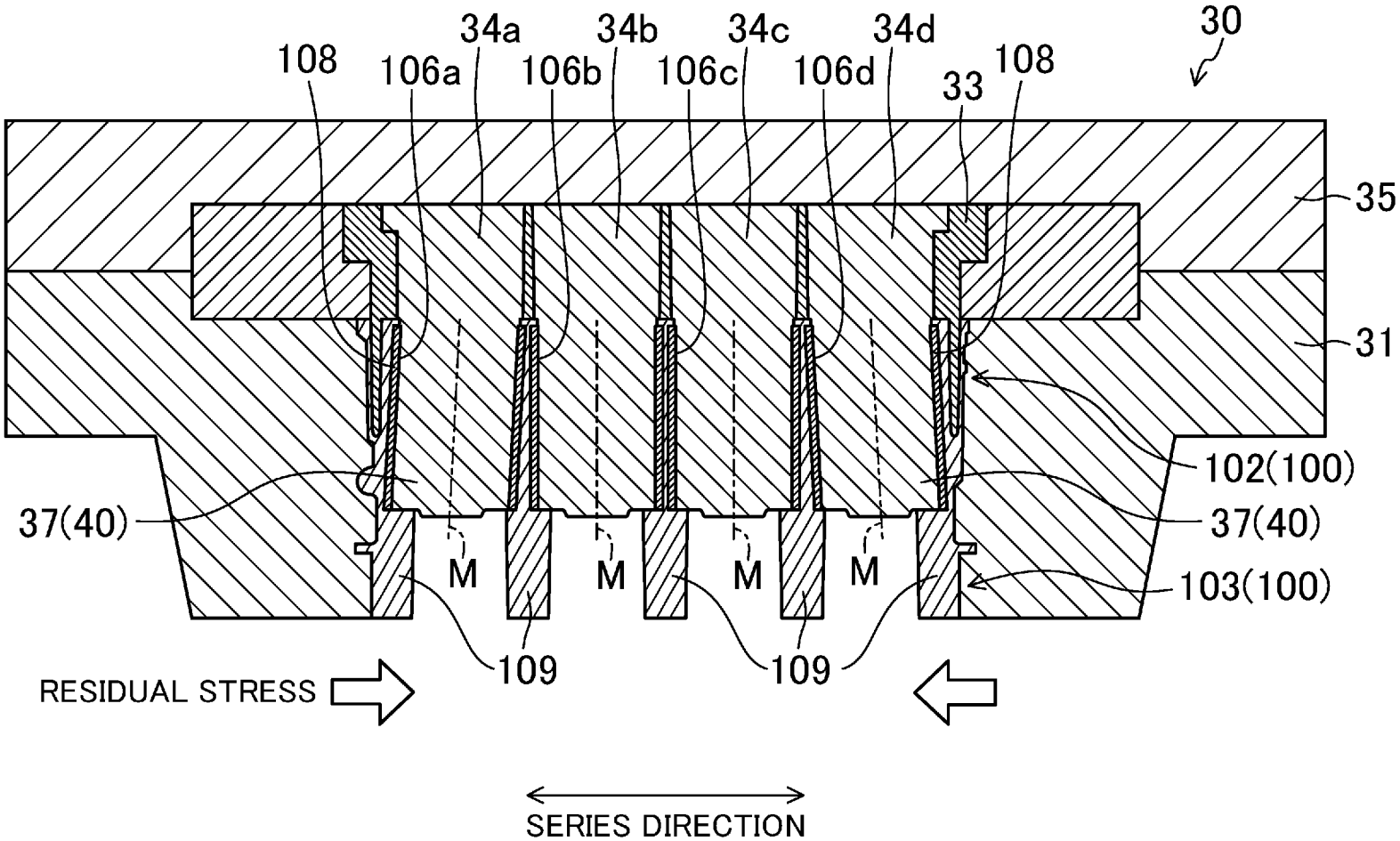
FIG. 6 is a cross-sectional view showing how the stationary mold is released from the state shown in FIG. 5.
Figure 7:
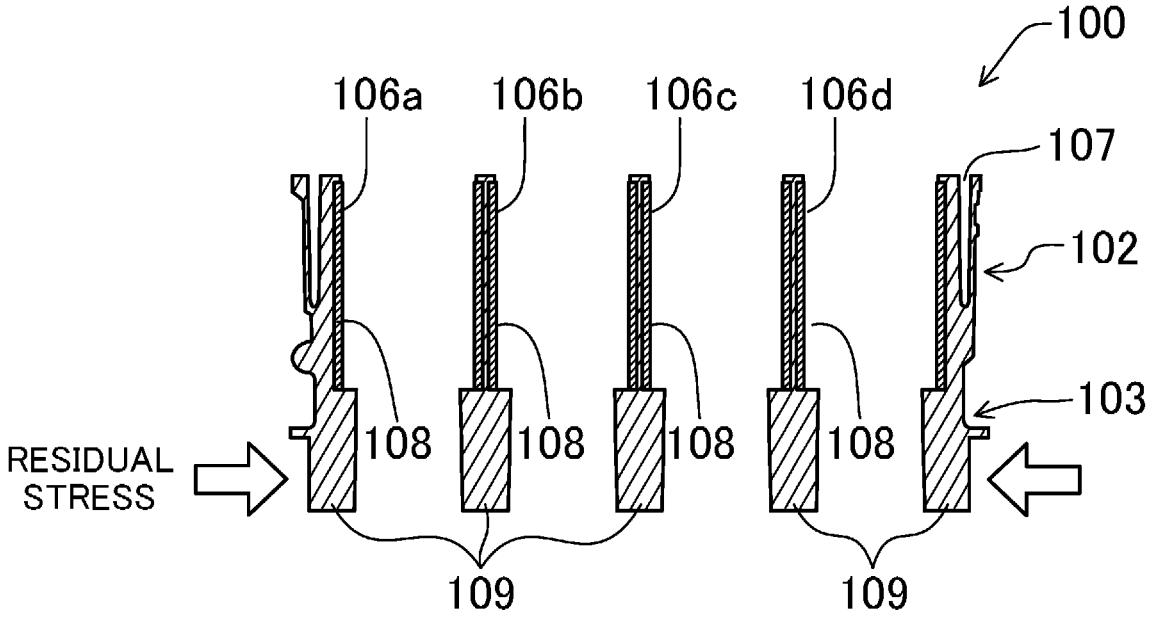
FIG. 7 is a cross-sectional view showing how the movable mold is released from the state shown in FIG. 6.

Specifically, according to the configuration described above, while the stationary and movable molds 20 and 30 are matched to form the cavity 60, the inclined portions 40 (the liner holders 37) of the first and fourth bore pins 34*a* and 34*d* are each inclined away from the bore pin 34 adjacent in the series direction (the second bore pin 34*b* for the first bore pin 34*a*, the third bore pin 34*c* for the fourth bore pin 34*d*) toward the distal end of the associated one of the first and fourth bore pin 34*a* and 34*d*, as shown in FIG. 5. Thus, the first cylinder bore 106*a* defined by the first bore pin 34*a* and the fourth cylinder bore 106*d* defined by the fourth bore pin 34*d* are inclined outwardly in the longitudinal direction of the cylinder bank toward the crankcase portion 103, as shown in FIG. 6, before the movable mold 30 is released. Thereafter, when the movable mold 30 is released, the residual stress arising from the shrinkage or deformation of the crankcase portion 103 is applied to the first and fourth cylinder bores 106*a* and 106*d*. The first and fourth cylinder bores 106*a* and 106*d* rotate, and are displaced, inwardly in the longitudinal direction of the cylinder bank due to the residual stress. Thus, the outward inclinations of the first and fourth cylinder bores 106*a* and 106*d* in the longitudinal direction of the cylinder bank before the release of the movable mold 30 are canceled. As a result, the inward inclinations of the first and fourth cylinder bores 106*a* and 106*d* in the longitudinal direction of the cylinder bank after the release of the movable mold 30 are reduced as shown in FIG. 7.

Thus, the inclinations, in the series direction, of the cylinder bores 106, in particular, the outermost ones of the cylinder bores 106 in the series direction (here, the first and fourth cylinder bores 106*a* and 106*d*), can be reduced, and the degree of reduction in fuel economy can be reduced.

In particular, in the first embodiment, the cylinder bores 106 of the cylinder block 100 are each defined by the associated cylinder liner 108. Thus, when the first and fourth cylinder bores 106*a* and 106*d* rotate, and are displaced, inwardly in the longitudinal direction of the cylinder bank due to the residual stress, two of the cylinder liners 108 defining the first and fourth cylinder bores 106*a* and 106*d* rotate, and are displaced. As a result, the first and fourth cylinder bores 106*a* and 106*d* uniformly rotate and are displaced. This can substantially prevent the first and fourth cylinder bores 106*a* and 106*d* from being curved in the longitudinal direction of the cylinder bank after the movable mold 30 is released. This can more effectively reduce the inclinations of the associated cylinder bores 106 in the longitudinal direction of the cylinder bank.

Here, the liner holders 37 of the first and fourth bore pins 34*a* and 34*d* serve as the inclined portions 40. This causes a problem about whether or not, when the movable mold 30 is to be released, the liner holders 37 of the first and fourth bore pins 34*a* and 34*d* can be removed from the associated cylinder bores 106 of the cylinder block 100. In this connection, when the stationary mold 20 is actually released, the cylinder liners 108 respectively held by the liner holders 37 of the first and fourth bore pins 34*a* and 34*d* are bent in the longitudinal direction of the cylinder bank under the stress arising from the shrinkage or deformation of the crankcase portion 103. Bending of the cylinder liners 108 causes a gap to be formed between the liner holder 37 of each of the first and fourth bore pins 34*a* and 34*d* and the cylinder liner 108 held by the liner holder 37. This gap allows the liner holder 37 of each of the first and fourth bore pins 34*a* and 34*d* to be removed from the associated cylinder bore 106 of the cylinder block 100 in releasing the movable mold 30. Therefore, the release of the movable mold 30 is not problematic. The actual inclination angle of each of the inclined portions 40 is about 0.1° to 0.3°. Thus, the release of the movable mold 30 is not particularly problematic.

Figure 8:
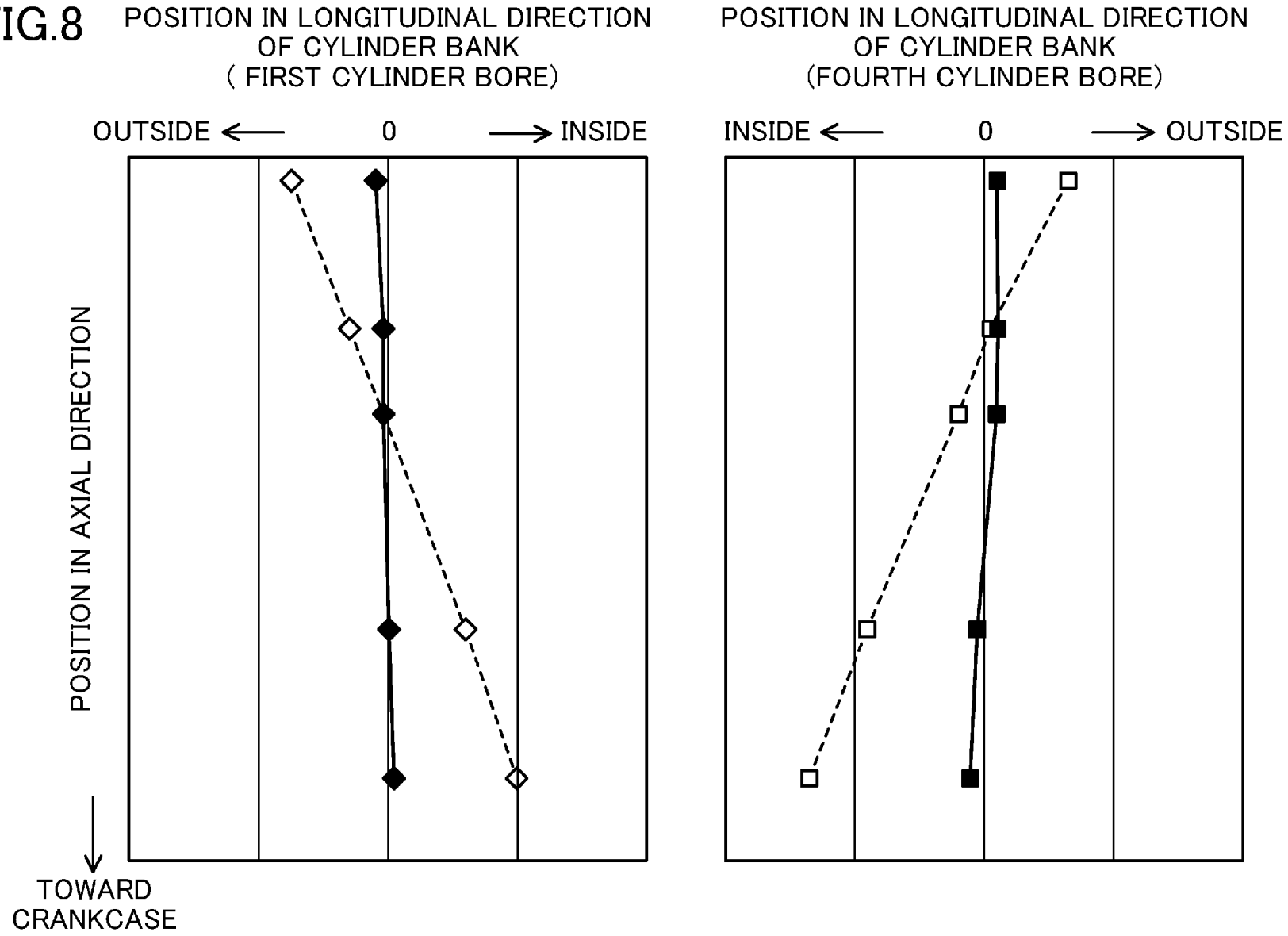
FIG. 8 is a graph showing comparison of the inclination of each of outermost ones of cylinder bores in a longitudinal direction of a cylinder bank between the known art and this embodiment.

FIG. 8 shows the inclinations of the first and fourth cylinder bores 106*a* and 106*d* of the cylinder block 100 actually cast using a known movable mold and the inclinations of the first and fourth cylinder bores 106*a* and 106*d* of the cylinder block 100 actually cast using the movable mold 30 of the first embodiment. One of the graphs shown in FIG. 8 relates to the first cylinder bore 106*a*, and the other graph shown in FIG. 8 relates to the fourth cylinder bore 106*d*. In each of the graphs, the dotted line indicates a case where the known movable mold is used, and the solid line indicates a case where the movable mold 30 of the first embodiment is used. In each of the cases where the known movable mold is used and where the movable mold 30 of the first embodiment is used, the first and fourth cylinder bores 106*a* and 106*d* are each defined by the associated cylinder liner 108.

In each of the graphs shown in FIG. 8, the vertical axis represents the vertical position of the axis of the cylinder bore 106, and the horizontal axis represents the position of the axis of the cylinder bore 106 in the longitudinal direction of the cylinder bank. The point 0 along the vertical axis corresponds to the position of the gasket surface 104. As the value increases from the point 0, the value indicates a position closer to the crankcase portion 103. The point 0 along the horizontal axis represents a position at which the axis of the cylinder bore 106 should be originally positioned in the longitudinal direction of the cylinder bank. In the (left) graph relating to the first cylinder bore 106*a*, a direction from the point 0 toward the negative side thereof corresponds to an outward direction along the longitudinal direction of the cylinder bank, and a direction from the point 0 toward the positive side thereof corresponds to an inward direction along the longitudinal direction of the cylinder bank. On the other hand, in the (right) graph relating to the fourth cylinder bore 106*d*, a direction from the point 0 toward the negative side thereof corresponds to the inward direction along the longitudinal direction of the cylinder bank, and a direction from the point 0 toward the positive side thereof corresponds to the outward direction along the longitudinal direction of the cylinder bank. Each of the graphs shown in FIG. 8 shows that as the inclination of each of the lines in the graph increases, the inclination of the associated cylinder bore 106 in the longitudinal direction of the cylinder bank increases.

As indicated by the dotted line in each of the graphs in FIG. 8, if the known movable mold is used, the first and fourth cylinder bores 106*a* and 106*d* are significantly inclined inwardly toward the crankcase portion 103 in the longitudinal direction of the cylinder bank. This results from the influence of the residual stress generated by the shrinkage or deformation of the crankcase portion 103 which occur when the stationary mold 20 is released. Specifically, since the first and fourth cylinder bores 106*a* and 106*d* are defined by the associated cylinder liners 108, the residual stress applied to the cylinder liners 108 causes end portions of the cylinder liners 108 near the crankcase portion 103 to be displaced inwardly in the longitudinal direction of the cylinder bank, and causes end portions of the cylinder liners 108 near the gasket surface 104 to be displaced outwardly in the longitudinal direction of the cylinder bank. In other words, the cylinder liners 108 rotate and are displaced about their vertically central portions. Thus, the first and fourth cylinder bores 106*a* and 106*d* are significantly inclined inwardly toward the crankcase portion 103 in the longitudinal direction of the cylinder bank.

On the other hand, as indicated by the solid line in each of the graphs in FIG. 8, using the movable mold 30 of the first embodiment reduces the inclinations of the first and fourth cylinder bores 106*a* and 106*d* in the longitudinal direction of the cylinder bank. This is because if the movable mold 30 of the first embodiment is used, the cylinder liners 108 of the first and fourth cylinder bores 106*a* and 106*d* are inclined outwardly in the longitudinal direction of the cylinder bank toward the crankcase portion 103 after the stationary mold 20 has been released and before the movable mold 30 is released; when the movable mold 30 is released and the resultant residual stress causes the cylinder liners 108 to rotate and be displaced, the outward inclinations of the first and fourth cylinder bores 106*a* and 106*d* in the longitudinal direction of the cylinder bank are canceled.

As can be seen from the foregoing description, it has been found that using the movable mold 30 of the first embodiment reduces the inclinations of the first and fourth cylinder bores 106*a* and 106*d* in the longitudinal direction of the cylinder bank. The inclination angle of each of the inclined portions 40 (that is to say, the liner holders 37) of the first and fourth bore pins 34*a* and 34*d* for forming the first and fourth cylinder bores 106*a* and 106*d*, (i.e., an acute one of the angles between the center axis of the inclined portion 40 of the first bore pin 34*a* and the center axis of the second bore pin 34*b* and an acute one of the angles between the center axis of the inclined portion 40 of the fourth bore pin 34*d* and the center axis of the third bore pin 34*c*, when viewed from the direction orthogonal to both the series direction and the extending direction of the center axes of the bore pins 34) is set, based on the foregoing results, to reduce the inclinations of the first and fourth bore pins 34*a* and 34*d* in the longitudinal direction of the cylinder bank when the movable mold 30 is released. Specifically, the inclination angles of the inclined portions 40 of the first and fourth bore pins 34*a* and 34*d* are set to be equal to about 0.1° to 0.3°.

Thus, in the first embodiment, the outermost ones, in the series direction, of the bore pins 34 (the first and fourth bore pins 34*a* and 34*d*) of the movable mold 30 each have the inclined portion 40 that is inclined away from the bore pin adjacent in the series direction (the second bore pin 34*b* for the first bore pin 34*a*, and the third bore pin 34*c* for the fourth bore pin 34*d*) toward the distal end of the bore pin, where the series direction represents the direction in which the bore pins 34 of the movable mold 30 are arranged and which corresponds to the longitudinal direction of the cylinder bank. This can reduce the inclinations, in the series direction, of the cylinder bores 106 of the cylinder block 100 that is cast using the movable mold 30, and can reduce the degree of reduction in fuel economy caused by the inclinations of the cylinder bores 106 in the longitudinal direction of the cylinder bank.

Second Embodiment

A second embodiment will now be described in detail with reference to the drawings. In the following description, the same reference characters as those in the first embodiment are used to represent equivalent elements, and the detailed explanation thereof will be omitted.

Figure 9:
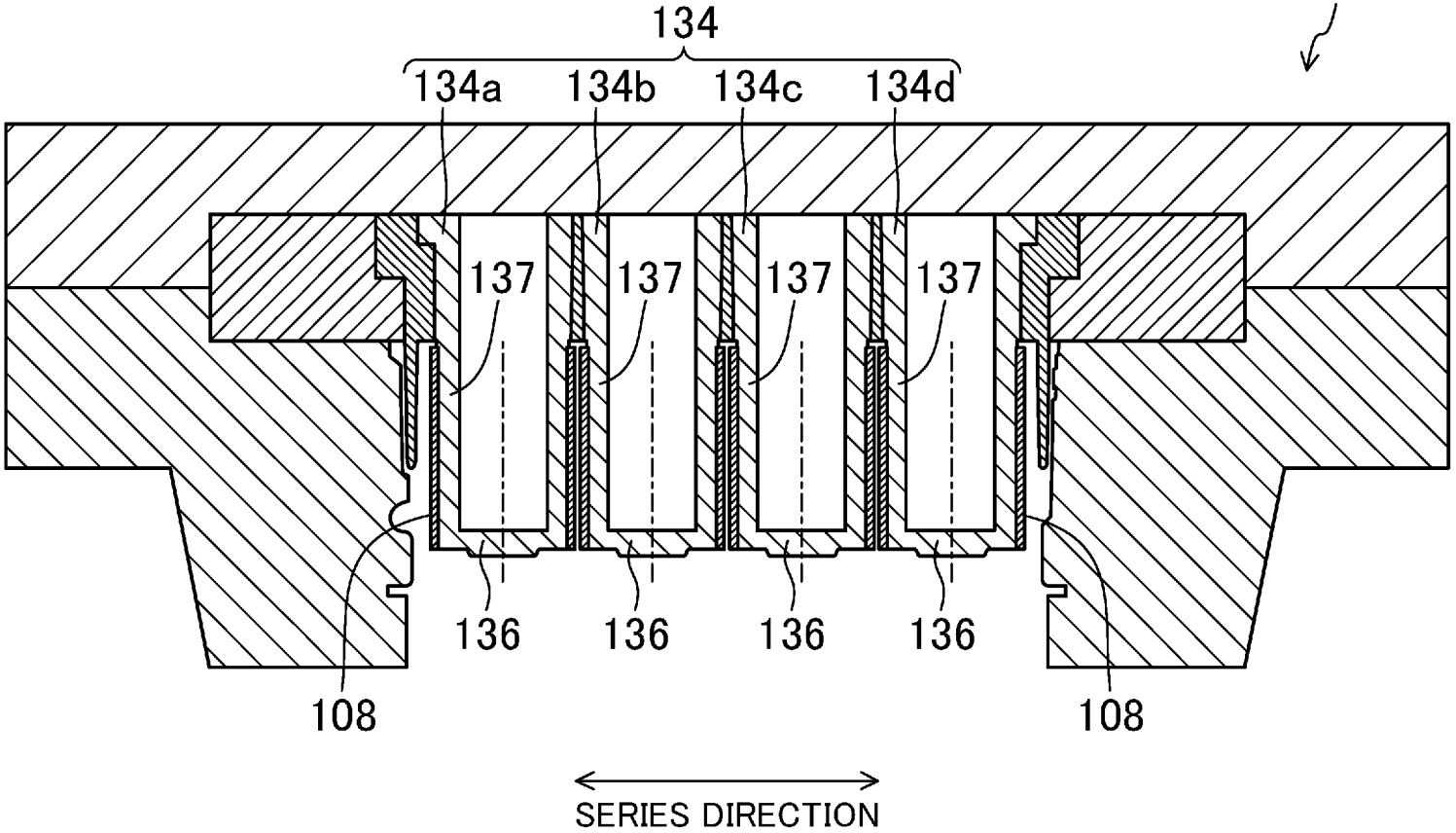
FIG. 9 is a cross-sectional view showing a movable mold for use in a casting device according to a second embodiment.

FIG. 9 shows a movable mold 130 according to the second embodiment. The movable mold 130 is distinguished from the movable mold 30 of the first embodiment in that liner holders 137 of bore pins 134 are hollow. The movable mold 130 is further distinguished from the movable mold 30 of the first embodiment in that the liner holders 137 of first and fourth bore pins 134*a* and 134*d* extend straight in a direction orthogonal to the series direction just like the liner holders 137 of second and third bore pins 134*b* and 134*c*. As will be described below in detail, a stationary mold 20 has the same configuration as that of the first embodiment.

In the second embodiment, since the liner holders 137 are hollow, the liner holders 137 are more flexible than the liner holders 37 of the first embodiment. This allows the liner holders 137 to be deformed and inclined toward their distal ends.

A distal end of each of the bore pins 134 of the movable mold 130 of the second embodiment has an engagement protruding portion 136, which engages with an associated one of engagement recesses 23 formed on a stationary mold core 21 of the stationary mold 20. As described above, in the second embodiment, the liner holders 137 of the first and fourth bore pins 134*a* and 134*d* extend straight in the direction orthogonal to the series direction. Thus, the engagement protruding portions 136 of the bore pins 134 are arranged at equal intervals in the series direction before the movable mold 130 is matched with the stationary mold 20.

The stationary mold 20 of the second embodiment has the same configuration as that of the first embodiment, and the positions of the engagement recesses 23 formed in the stationary mold core 21 are also the same as those of the first embodiment. Specifically, the engagement recesses 23 are formed such that the distance L1' between the midpoints of the first and second engagement recesses 23*a* and 23*b* in the series direction and the distance L2' between the midpoints of the fourth and third engagement recesses 23*d* and 23*c* in the series direction are each longer than the distance L3' between the midpoints of the second and third engagement recesses 23*b* and 23*c* in the series direction, where the engagement recesses 23 engaging with the engagement protruding portions 136 of the first, second, third, and fourth bore pins 134*a*, 134*b*, 134*c*, and 134*d*, respectively are referred to as the "first, second, third, and fourth engagement recesses 23*a*, 23*b*, 23*c*, and 23*d*, respectively."

Figure 10:
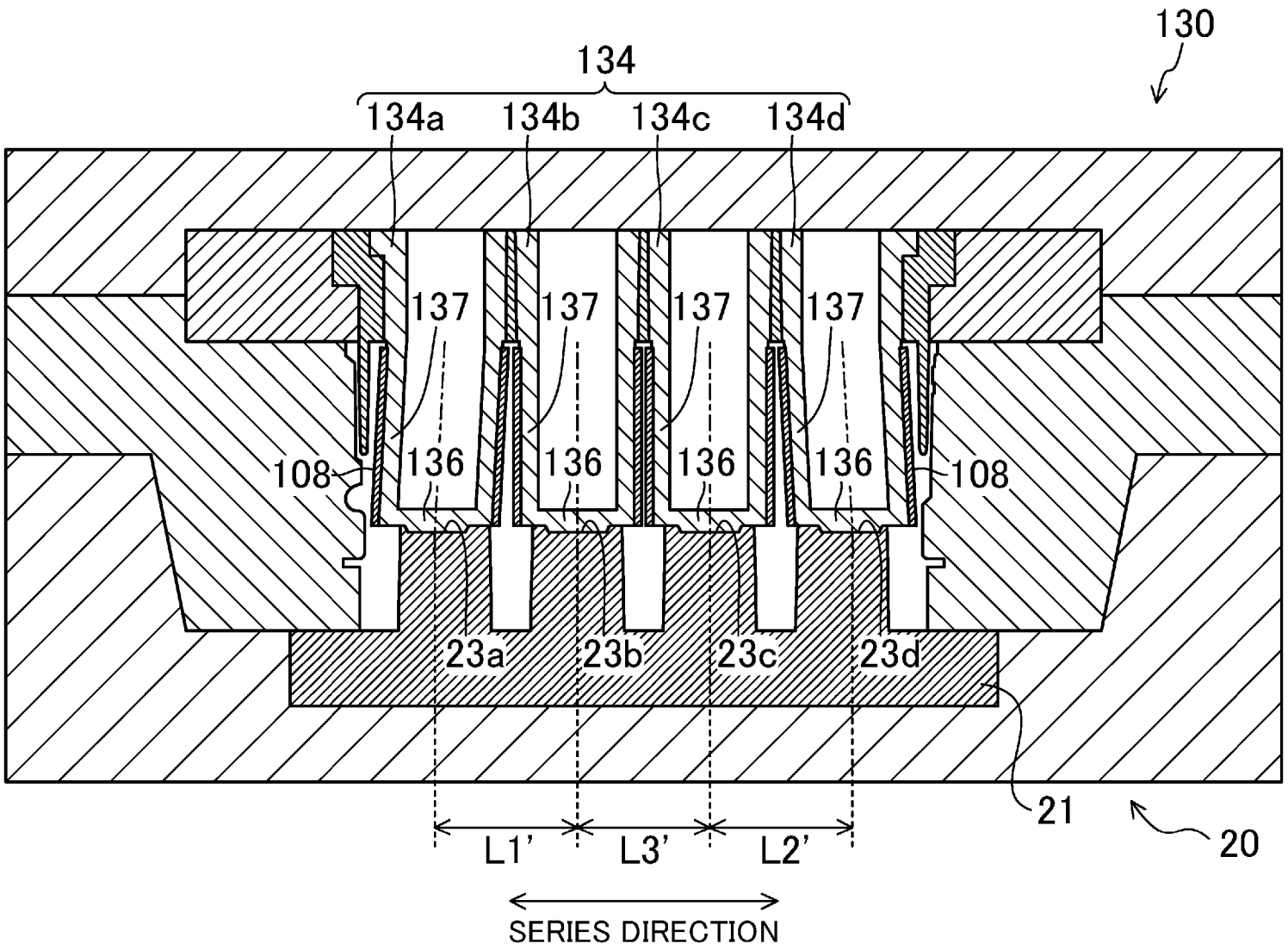
FIG. 10 is a cross-sectional view showing how the movable mold according to the second embodiment is matched with a stationary mold.

FIG. 10 shows how the movable mold 130 according to the second embodiment is matched with the stationary mold 20.

The engagement protruding portions 136 of the bore pins 134 of the movable mold 130 are arranged at equal intervals in the series direction, whereas the engagement recesses 23 of the stationary mold 20 are arranged as described above. Thus, when the engagement protruding portions 136 of the first and fourth bore pins 134*a* and 134*d* are respectively engaged with the first and fourth engagement recesses 23*a* and 23*d*, the first and fourth bore pins 134*a* and 134*d* need to be respectively inclined away from the second and third bore pins 134*b* and 134*c* toward their respective distal ends. In the second embodiment, since the liner holders 137 of the bore pins 134 are hollow, the first and fourth bore pins 134*a* and 134*d* can be deformed to be inclined toward their respective distal ends. As a result, as shown in FIG. 10, while the movable mold 130 and the stationary mold 20 are matched, the first and fourth bore pins 134*a* and 134*d* are each inclined away from the bore pins 134 adjacent in the series direction (the second bore pin 134*b* for the first bore pin 134*a*, and the third bore pin 134*c* for the fourth bore pin 134) toward the distal end of the respective bore pins 134.

As described above, also in the second embodiment, the movable mold 130 is matched with the stationary mold 20 such that the outermost ones of the bore pins 134 of the movable mold 130 in the series direction (the first and fourth bore pins 134*a* and 134*d*) are each inclined away from the bore pin 134 adjacent in the series direction (the second bore pin 134*b* for the first bore pin 134*a*, and the third bore pin 134*c* for the fourth bore pin 134*d*) toward the distal end of the respective outermost bore pins 134.

Thus, if molten metal is injected into a cavity 60 defined by the stationary mold 20 and the movable mold 130 that are matched as described above, and a cylinder block 100 is thus cast, the first cylinder bore 106*a* defined by the first bore pin 134*a* and the fourth cylinder bore 106*d* defined by the fourth bore pin 134*d* are inclined outwardly in the longitudinal direction of the cylinder bank toward a crankcase portion 103 before the movable mold 130 is released, just like the first embodiment. Thereafter, when the movable mold 130 is released, and residual stress arising from the shrinkage or deformation of the crankcase portion 103 is applied to the first and fourth cylinder bores 106*a* and 106*d*, the first and fourth cylinder bores 106*a* and 106*d* rotate, and are displaced, inwardly in the longitudinal direction of the cylinder bank. Thus, the outward inclinations of the first and fourth cylinder bores 106*a* and 106*d* in the longitudinal direction of the cylinder bank before the release of the movable mold 130 are canceled. As a result, the inward inclinations of the first and fourth cylinder bores 106*a* and 106*d* in the longitudinal direction of the cylinder bank after the release of the movable mold 130 are reduced.

Thus, the second embodiment can also reduce the inclinations, in the series direction, of the cylinder bores 106 of the cylinder block 100 cast using the movable mold 130, and can also reduce the degree of reduction in fuel economy caused by the inclinations of the cylinder bores 106 in the longitudinal direction of the cylinder bank.

Other Embodiments

The present disclosure is not limited to the embodiments described above. Any change can be made within the scope of the claims as appropriate.

For example, the description of the foregoing first and second embodiments has been intended for the cylinder block 100 having the cylinder bores 106 defined by the cylinder liners 108. Such a cylinder block is merely an example. The foregoing first and second embodiments may be intended for a cylinder block 100 having cylinder bores 106 not defined by cylinder liners 108. In this case, each bore pin 34, 134 does not have to be provided with a liner holder 37, 137.

The foregoing first and second embodiments have been intended for a cylinder block 100 for use in a multi-cylinder engine including four in-line cylinders. Such a cylinder block is merely an example. The foregoing first and second embodiments may be intended for a cylinder block for use in a multi-cylinder engine including five or more cylinders arranged in a line.

Furthermore, the present disclosure may be used for a V engine including cylinders arranged in a V-shape. In this case, two cylinder banks are formed. Thus, two rows of bore pins, which each form one of the cylinder banks, are also formed. Thus, a movable mold needs to be formed such that the outermost ones of a plurality of bore pins in the series direction each have an inclined portion that is inclined away from the bore pin adjacent in the series direction toward the distal end of the bore pin.

The foregoing embodiments are merely preferred examples in nature, and the scope of the present disclosure should not be interpreted in a limited manner. The scope of the present disclosure is defined by the appended claims, and all variations and modifications belonging to a range equivalent to the range of the claims are within the scope of the present disclosure.

INDUSTRIAL APPLICABILITY

The present disclosure is useful for casting an open deck cylinder block including a portion of a bearing portion of a crankshaft and a portion of a crankcase.

DESCRIPTION OF REFERENCE CHARACTERS

1 Engine
10 Casting Device
20 Stationary Mold (First Mold, Casting Mold)
30, 130 Movable Mold (Second Mold, Casting Mold)
34, 134 Bore Pin
34*a*, 134*a* First Bore Pin (an outermost one of a plurality of bore pins in a series direction)
34*b*, 134*b* Second Bore Pin (another one of the bore pins adjacent in the series direction)
34*c*, 134*c* Third Bore Pin (still another one of the bore pins adjacent in the series direction)
34*d*, 134*d* Fourth Bore Pin (another outermost one of the bore pins in the series direction)
37, 137 Liner Holder
40 Inclined Portion
50 Injection Device
60 Cavity
100 Cylinder Block
103 Crankcase Portion (a portion of a crankcase)
106 Cylinder Bore
108 Cylinder Liner
109 Bearing Portion

The invention claimed is:

1. A casting device for a cylinder block of an engine, the casting device being configured to cast an open deck cylinder block including a portion of a bearing portion of a crankshaft and a portion of a crankcase, wherein the engine is a multi-cylinder engine including a plurality of cylinders all arranged in a row in a crankshaft direction so that the crankshaft direction corresponds to a cylinder bank direction, the casting device comprises:

a first mold configured to form the portion of the bearing portion and the portion of the crankcase;

a second mold including a plurality of bore pins respectively defining cylinder bores of the plurality of cylinders, the bore pins being arranged to correspond to the plurality of cylinders; and an injection device configured to inject molten metal into a cavity formed by matching the first and second molds, and of the plurality of bore pins, two outermost bore pins in a series direction each have an inclined portion that is inclined away from an adjacent bore pin in the series direction toward a distal end of the outermost bore pin, where the series direction represents a direction in which the plurality of bore pins are arranged and which corresponds to the cylinder bank direction.

2. The device of claim 1, wherein the cylinder bores of the cylinders are each defined by a cylinder liner that is cast in an alloy, the bore pins each have a liner holder configured to hold the cylinder liner, the inclined portions are configured as the liner holders of the outermost bore pins, and while the cylinder liners are respectively held by the liner holders, and the first and second molds are matched, the injection device injects molten metal into the cavity.

3. The casting device of claim 2, wherein the engine is an in-line multi-cylinder engine including four cylinders, the second mold has four bore pins, the four bore pins include a first bore pin, a second bore pin, a third bore pin, and a fourth bore pin in this order from a first side in the series direction to a second side, the first bore pin has a liner holder extending from a base end of the first bore pin toward a distal end of the first bore pin so as to be inclined away from the second bore pin toward the first side in the series direction, while the fourth bore pin has a liner holder extending from a base end of the fourth bore pin to a distal end of the fourth bore pin so as to be inclined away from the third bore pin toward the second side in the series direction, and the first and fourth bore pins are formed so that a gap between the base end of the liner holder of the first bore pin and a base end of a liner holder of the second bore pin and a gap between the base end of the liner holder of the fourth bore pin and a base end of a liner holder of the third bore pin are each smaller than a gap between the base end of the liner holder of the second bore pin and the base end of the liner holder of the third bore pin.

4. The casting device of claim 1, wherein an inclination angle of the inclined portion is 0.1° to 0.3°.

5. A casting mold for a cylinder block of an engine, the casting mold being configured to cast an open deck cylinder block including a portion of a bearing portion of a crankshaft and a portion of a crankcase, wherein the engine is a multi-cylinder engine including a plurality of cylinders all arranged in a row in a crankshaft direction so that the crankshaft direction corresponds to a cylinder bank direction, the casting mold comprises:

a first mold configured to form the portion of the bearing portion and the portion of the crankcase; and a second mold including a plurality of bore pins respectively defining cylinder bores of the cylinders, the bore pins being arranged to correspond to the plurality of cylinders, the second mold being matched with the first mold to form a cavity to cast the cylinder block, and of the plurality of bore pins, two outermost bore pins in a series direction each have an inclined portion that is inclined away from an adjacent bore pin in the series direction toward a distal end of the outermost bore pin, where the series direction represents a direction in which the plurality of bore pins are arranged and which corresponds to the cylinder bank direction.

6. The casting mold of claim 5, wherein the cylinder bores of the cylinders are each defined by a cylinder liner that is cast in an alloy, the bore pins each have a liner holder configured to hold the cylinder liner, and each of the inclined portions is configured as the liner holder.

7. A method for casting a cylinder block of an engine, the method being used to cast an open deck cylinder block including a portion of a bearing portion of a crankshaft and a portion of a crankcase, the engine being a multi-cylinder engine including a plurality of cylinders all arranged in a row in a crankshaft direction so that the crankshaft direction corresponds to a cylinder bank direction, the method comprising:

matching a first mold and a second mold together to form a cavity to cast the cylinder block, the first mold being configured to form the bearing portion and the crankcase, the second mold including a plurality of bore pins respectively defining cylinder bores of the cylinders, the bore pins being arranged to correspond to the plurality of cylinders;

injecting molten metal into the cavity formed in the matching; and after the injecting of the molten metal, releasing the first mold and then releasing the second mold, wherein in the matching, the second mold is matched with the first mold such that portions of two outermost bore pins of the plurality of bore pins in a series direction are inclined away from an adjacent bore pin in the series direction toward a distal end of the outermost bore pin, where the series direction represents a direction in which the plurality of bore pins are arranged and which corresponds to the cylinder bank direction.

8. The method of claim 7, wherein the second mold is formed such that the portions of the outermost bore pins are each inclined before the second mold is matched with the first mold in the matching, and in the matching, the second mold is matched with the first mold.

9. The method of claim 8, wherein the cylinder bores of the cylinders are each defined by a cylinder liner that is cast in an alloy, the bore pins of the second mold each have a liner holder configured to hold the cylinder liner, the method further includes, before the matching, holding the cylinder liners on the respective bore pins of the second mold, the cylinder liners respectively holding the cylinders, and in the matching, the second mold is matched with the first mold such that the liner holders of the outermost bore pins in the series direction are each inclined away from the adjacent bore pin in the series direction toward the distal end of the outermost bore pin.

10. The method of claim 8, wherein the cylinder block is an upper block to be fastened to a lower block including remaining portions of the bearing portion and the crankcase.

11. The method of claim 7, wherein the cylinder bores of the cylinders are each defined by a cylinder liner that is cast in an alloy, the bore pins of the second mold each have a liner holder configured to hold the cylinder liner, the method further includes, before the matching, holding the cylinder liners on the respective bore pins of the second mold, the cylinder liners respectively holding the cylinders, and in the matching, the second mold is matched with the first mold such that the liner holders of the outermost bore pins in the series direction are each inclined away from the adjacent bore pin in the series direction toward the distal end of the outermost bore pin.

12. The method of claim 11, wherein the cylinder block is an upper block to be fastened to a lower block including remaining portions of the bearing portion and the crankcase.

13. The method of claim 7, wherein the cylinder block is an upper block to be fastened to a lower block including remaining portions of the bearing portion and the crankcase.

* * * * *